United States Patent [19]

Rockola et al.

[11] 4,306,644

[45] Dec. 22, 1981

[54] COIN CHUTE FOR VENDING MACHINE

[75] Inventors: Donald C. Rockola, Chicago; Floyd V. Bookout, Arlington Heights; Clifford F. Czech, Westchester, all of Ill.

[73] Assignee: Rock-Ola Manufacturing Corporation, Chicago, Ill.

[21] Appl. No.: 162,788

[22] Filed: Jun. 25, 1980

[51] Int. Cl.[3] ..... G07F 3/04

[52] U.S. Cl. ..... 194/1 K; 194/97 R

[58] Field of Search ..... 194/1 R, 1 K, 97 R

[56] References Cited

U.S. PATENT DOCUMENTS

| | | | |
|---|---|---|---|
| 3,589,493 | 6/1971 | Hall | 194/102 |
| 4,062,435 | 12/1977 | Chalabian | 194/1 KX |
| 4,230,213 | 10/1980 | Spring | 194/1 K |

*Primary Examiner*—Joseph J. Rolla

*Attorney, Agent, or Firm*—McCaleb, Lucas & Brugman

[57] ABSTRACT

A coin chute structure for conveying coins from a coin receptive slot to a remotely disposed coin receptor apparatus; the chute structure being distinguished by a partially open bottom structure capable of supporting coins passing thereover while effectively intercepting any liquids injected into the chute so as to deflect the same harmlessly away from the coin receptor apparatus.

2 Claims, 4 Drawing Figures

Fig. 1.
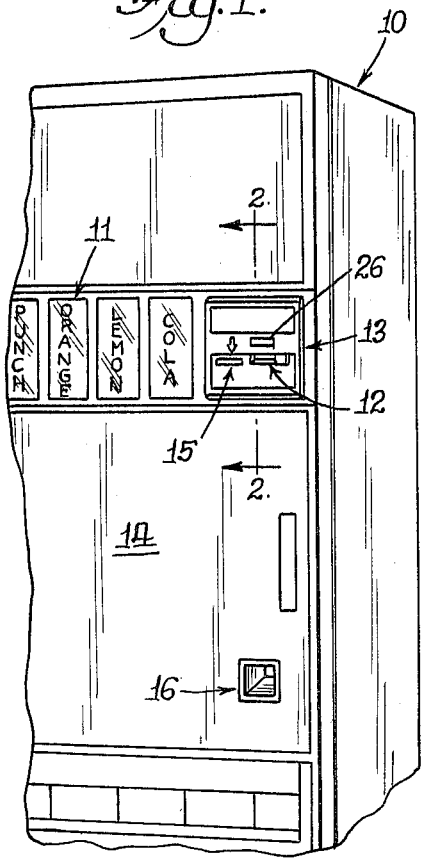
Fig. 2
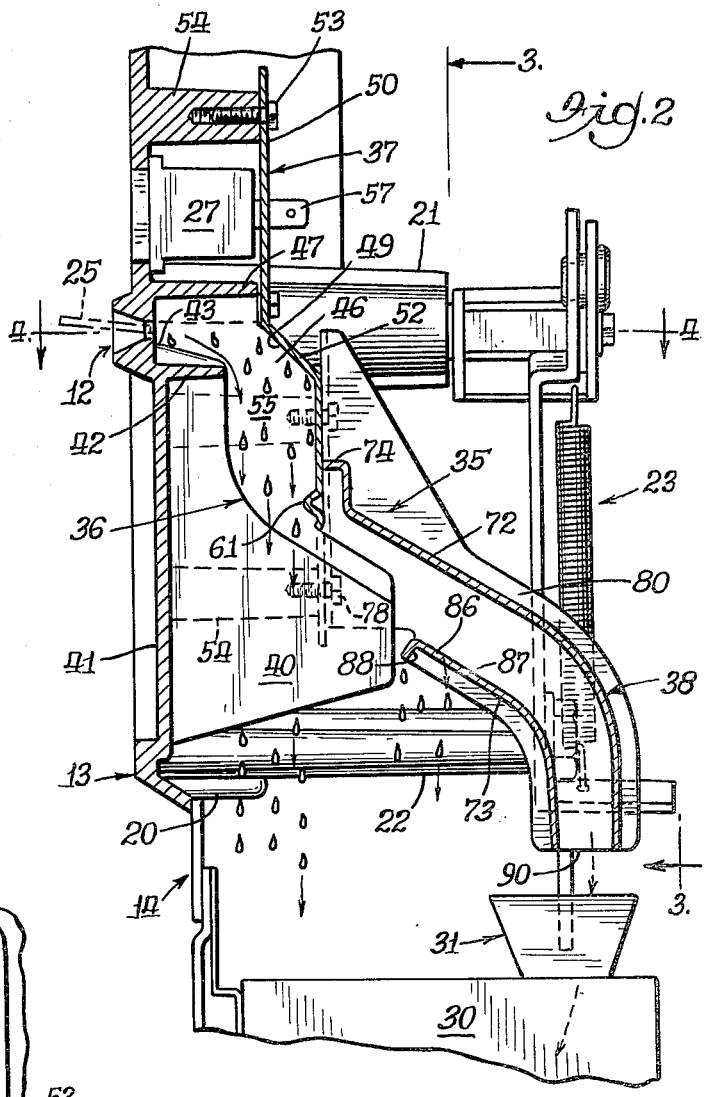
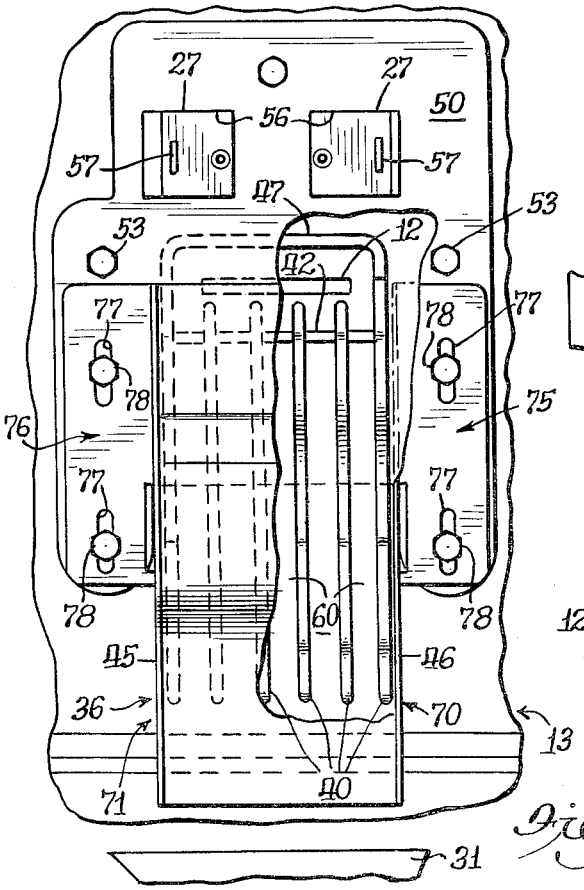
Fig. 3.
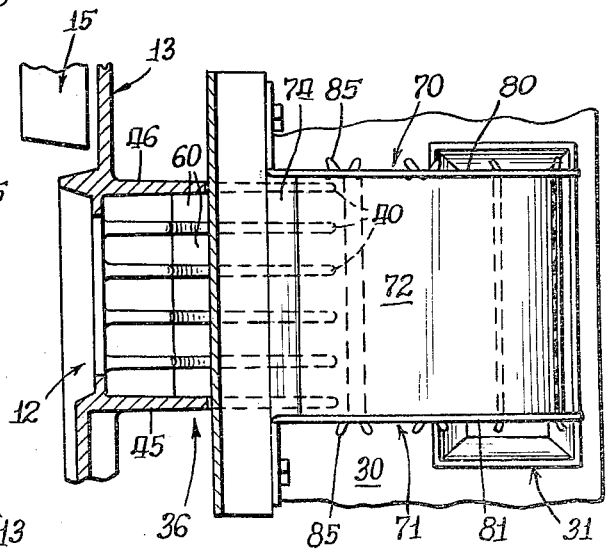
Fig. 4.

COIN CHUTE FOR VENDING MACHINE

In the operation of automatic, coin-controlled vending machines, the coins normally are inserted into a coin receptive slot and conveyed along a chute by gravity to a coin box, the same being accepted or rejected and counted enroute.

In a typical system, counting of the coins is accomplished by passing the coins over switch or other circuit control means located along the path of the falling coins; the coins first having been separated according to denomination and size. Actuation of the circuit control or switch means effects a credit and when sufficient credit is accumulated, the vending cycle may be initiated, to bring about delivery of selected commodities to the customer.

Unfortunately certain unscrupulous customers constantly strive for ways to cheat or beat such machines. One of the more insidious schemes encountered of late, involves the pouring or squirting of liquid, such as salt water, into the coin chute via the coin receptive slot. This operation is typically carried out by using a plastic squeeze bottle having a long spout, such as the familiar plastic mustard of ketsup dispenser used in restaurants. In other instances, a thin plastic tube is attached to the squeeze bottle which is then inserted into the coin slot, to circumvent any barriers or other preventative devices.

When liquid is squirted into the coin slot of a typical vending machine, the liquid runs down the coin chute and sprays over the coin receiving, counting and credit mechanisms thereby shorting their related circuits and generally damaging the apparatus. On ocassion such shorting may cause a machine to "jack pot" i.e. vend one or more times or even until all merchandise is vended. In still other instances the shorted circuits may cause money to be dispensed through the change or coin return mechanism, depending on the nature of the coin receptive device.

Although there have been many attempts to avoid the above noted difficulty, to our knowledge there have been no fully successful solutions presented prior to the current invention.

In brief, the present invention is directed to improvements in coin chute means used to feed coin receptors of automatic, coin operated vending machines and comprises means for positively diverting liquid introduced into the coin receiving chute so that the same is caused to fall or course harmlessly away from the sensitive coin counting and credit circuits or other electrical and/or mechanical systems associated with the coin receptor. The means for positively diverting the liquid comprises a plurality of parallel spaced, vertical rib members forming an open bottom wall for the coin chute and providing a circuitous coin passageway; the spaced ribs or projections providing a gridlike drain for rapid drainage of the liquid thereby to prevent the same from entering the coin receptor. Removable plate means form a back wall for the coin passageway, enclosing the same and cooperating with the projecting ribs to divert liquid away from the coin receptor. In addition, an extension chute is affixed adjacent the backing plate to channel the falling coins outwardly away from the path of any liquid entering the coin receptive slot; the same having one bottom wall thereof provided with spaced limber openings to drain off any droplets or spray that may enter or condense in the coin passageway of the extension chute. The combination of chute drain and passageway means so provided effectively prevents moisture from entering directly into the coin receiving apparatus and is effective to harmlessly divert any liquid away from the coin counting, crediting and other related circuitry and delicate mechanisms.

It is a principle object of this invention to provide an improved coin chute means for use with automatic coin operated vending machines which is capable of preventing liquid introduced into the coin slot and chute from passing into the coin counting and receiving apparatus.

Another object of this invention is to provide an improved structure for a coin chute which is capable of positively diverting liquid introduced into the upper end of the chute from entering the delicate coin counting, crediting and related mechanisms and electrical circuitry.

Having thus described this invention, the above and further objects, features and advantages thereof will be recognized by those familiar with the art from the following description of a preferred embodiment, illustrated in the accompanying drawings and representing the best mode presently contemplated for carrying out its concepts and teachings.

IN THE DRAWINGS

FIG. 1 is a partial perspective showing of a typical coin operated vending machine equipped with the coin chute of this invention;

FIG. 2 is an enlarged transverse cross-sectional view of the improved coin chute of this invention, taken substantially along vantage line 2—2 of FIG. 1 and looking in the direction of the arrows thereon;

FIG. 3 is a rear plan view with parts broken away, taken substantially along vantage line 3—3 of FIG. 2 and looking in the direction of the arrows thereon; and FIG. 4 is a top plan view taken substantially along vantage line 4—4 of FIG. 2 and looking in the direction of the arrows thereon; portions thereof being shown in section.

DESCRIPTION OF THE PREFERRED EMBODIMENT

As illustrated in FIG. 1, a typical can vending machine 10, partially illustrated thereat, is equipped with a plurality of item selection panels 11 which, when depressed, serve to initiate a vend cycle after deposit of a requisite coin value. Coins are deposited via a coin receiving slot 12 provided in a face plate 13 mounted on the front panel 14 of the machine. Face plate 13 is further equipped with a coin return lever 15 whereby deposited coins may be returned through a return chute 16.

As will be recognized from examination of FIG. 2, the face plate 13 preferrably is made as a metal casting which is mounted over an appropriate opening formed in the front door or panel 14 of the vending machine; the same being provided with a plurality of mounting posts 20 extending from its back side for receiving speed nut fasteners, or the like, used to retain the plate in operating position. It further will be noted that the configuration of the plate 13 is such as to provide a pair of rearwardly extending bosses 21 and 22 which mount a portion of the coin return or refund mechanism indicated generally at 23 and which, while associated with the mounting plate 13, forms no particular part of the current invention and therefore will not be described in particular detail. It will be noted, however, that mechanism 23 is actuated by means of a shaft (not shown) having the coin return lever 15 at its outer end, externally over the outer face of the plate 13 and available to the customer for operation.

As noted previously, the mounting plate 13 includes a horizontally disposed coin receiving slot 12, herein illustrated as having a throat of generally frustoconical or trapazoidal shaped cross-section, for the easy insertion and reception of coins 25, as indicated in FIG. 2. Located above the coin receptive slot 12 is an indicator lamp 26 having a pair of terminal posts 27, 27 extending rearwardly of mounting plate 13. Indicator 26 advises the customer with specific instructions such as "deposit coin", and "make selection", etc.; the same being appropriately lighted for catching the attention of the customer. Disposed below the mounting plate and located behind the front panel 14 is a schematically indicated coin receptor means 30 having a funnel portion 31 into which the coins fall after they have been deposited in the coin receiving slot 12, as will appear presently.

With specific reference to FIGS. 2, 3 and 4 of the drawings, it will be seen that to provide a coin pathway or conveyance means between the coin receiving slot 12 and the coin receptive funnel 31 of the receptor 30 according to this invention, a chute means, indicated generally by numeral 35, is provided on the backside of the face plate 13. Such chute means is herein illustrated as comprising three major parts or means, namely a drain means 36, a backing plate 37 and extension chute means 38, which will now be described in detail.

The drain means 36, as illustrated best in FIGS. 3 and 4, comprises a plurality of vertical rib walls 40, disposed in spaced parallelism on the back side of the mounting plate 13 and preferably cast to extend outwardly from vertical wall 41 thereof. In the particular illustrated embodiment hereof, four such rib walls 40 are shown (see FIG. 3). The upper reaches of the several walls 40 extend to substantially the level of the coin receiving slot 12 whereat they are interjoined by a cross connecting transverse web wall portion 42. It also will be noted that the uppermost end edges 43 of the several rib walls 40 slope downwardly from the coin receptive slot 12 as illustrated in FIG. 2; such sloping portions being disposed above the transverse web wall portion 42.

The rearwardly outermost or free edges 44 of the several spaced walls 40 drop vertically from wall portion 42 and are generally curvilinear in shape to comprise in their cooperative arrangement a bottom chute wall for guiding the passage of coins 25 therealong, as the same gravitate downwardly from the coin slot 12.

Located laterally outwardly and over the several spaced rib walls 40 are two deeper dimensioned parallel side wall portions 45 and 46 and a cross-connecting top wall portion 47; the three wall portions 45, 46 and 47 being integrally formed and cast with the plate 13, with the top wall portion disposed above the coin receiving slot 12. Such three wall portions act as an enclosure shield over the slot and about three sides of the several rib walls to form with back plate 37, an appropriate coin receptive chamber and passageway for the movement of coins.

It will be seen from FIG. 2, that the elevational profile of the side wall portions 45 and 46 does not include the curvilinear outer edge portions corresponding to edges 44 of the several rib wall members 40. Instead the rearward edges of the side wall portions 45 and 46 extend rearwardly and angulate at 49 to accomodate a corresponding formation of the backing plate 37; the latter being fabricated to comprise an upper planar plate portion 50 and a lower generally planar plate portion 51 which is parallel, but offset from portion 50 by an intervening angularly disposed wall portion 52 which abuttingly engages the angularly disposed edge portions 49 of the two side wall portions 45 and 46 in assembly.

As best shown in FIG. 3, the backing plate 37 is mounted over the upper regions of the several rib wall members 40 in abutting engagement with the rearward edges of the side wall portion 45 and 46 so as to lie in spaced relationship rearwardly of the free edge portions 44 of the several vertical rib walls 40. Mounting of the back plate 37 is accomplished by means of machine screws 53, or like fasteners, threadingly receptive in spaced mounting bosses extending integrally rearwardly from the face plate wall 41 (see FIG. 2). Thus secured to the face plate 13, the backing plate 37 cooperates with the upper regional portions of the several walls 40, 45, 46 and 47 to provide a coin receptive chamber 55 located rearwardly of the curvilinear edges 44 of the walls 40. This chamber 55 is in open communication with the coin receiving slot 12 at its upper end and initially receives any liquid which may be poured or squirted through the coin slot 12.

It also will be noted that the upper wall portion 50 of the plate 37 is provided with a pair of laterally spaced openings 56, 56 (see FIG. 3) through which the terminal portions 27, 27 of the ready light extend, thereby presenting their terminal connectors 57 for hook-up with appropriate electrical conductors.

The backing plate 37 and particularly the portions thereof comprising the angularly disposed web wall 52 and the operationally vertically disposed wall portion 51, act as a splash board or barrier for deflecting any liquid entering the horizontal coin slot 12 toward the frontal wall 41 of the face plate. Consequently, such re-directed liquid gravitates downwardly through the openings or spaces 60 between the several rib walls 40 (see FIG. 4). This reverse flow direction of the liquid is indicated by the droplets illustrated in FIG. 2, for example.

It also is important to note that wall portion 51 of the plate 37 includes an inwardly directed, horizontal drip bead 61 which extends or projects into the lower regions of the chamber 55. This bead acts as a drip shield and serves to gather any liquid running down the inside face of the backing plate portions 51 and 52, causing the same to drop vertically downwardly into the openings between the several wall portions 40. In addition bead 61 also serves to intercept any flexible tube or the like, inserted through slot 12; jamming the same against further insertion or deflecting the same backwardly toward the rib walls 40 where any liquid from the tube will pass harmlessly through the drain means. Thus substantially all liquid entering the coin receptive slot 12 is deflected by the wall portions 51, 52 and 61 of the plate 37 and directed downwardly thereby to pass harmlessly away from the coin receiver funnel 31 of receptor 30.

Turning now to the extension chute means 38, the same, (FIGS. 2, 3 and 4), is shown as a fabricated structure of sheet metal, such as galvanized steel or the like, made up of four members, namely, two parallel side wall members 70, 71, a top wall member 72 and a bottom wall member 73.

The top wall member has a generally downwardly curved profile, as best shown in FIG. 2, with the upper end thereof comprising an L-shaped formation presenting an abuttment portion 74 for engaging the outside of the backing plate 37 in assembly; such portion 74 being located adjacently above the horizontal drip bead 61.

The bottom wall 73 is likewise of generally curvilinear configuration following the general curvature adjacent the lower end of the upper wall member 72, so as to substantially parallel the latter in its operating position between the side wall members 70 and 71. Note that wall 73 is considerably shorter than the upper wall 72.

The two side wall members 70 and 71 are formed substantially alike except for reversal of laterally extending planar mounting ear portions 75 and 76 thereof respectively, (see FIG. 3). Such ear portions are formed with spaced elongated slotted openings 77 receptive of mounting screws 78 for attaching the extension chute means 38 over the lower regions of the back plate 37. The slotted openings 77 permit vertical adjustment of the extension chute means 38 to regulate its spacing from walls 40. Specifically, the side wall members 70 and 71 have planar main body portions 80 and 81, respectively, (see FIG. 4) which merge into integrally related laterally extending mounting ears 75 or 76. The remainder of the body portions 80 and 81 are curvilinear fashioned to follow the general contour of the two walls 72 and 73, the latter of which are disposed abuttingly between the side wall members 70 and 71 and are locked thereto, as by suitable openings formed through the side walls and locking ears 85 when project outwardly from the lateral edges of the upper and lower wall members 72 and 73. This provides a simple fabricated extension chute structure 38.

Aside from the general aspects of the extension chute structure as above described, the bottom wall member 73 thereof is uniquely provided with a series of limber openings 86, 87 which are suitably spaced across its upper end regions. A downwardly turned lip portion 88 is provided at its upper end for disposition adjacent the lower ends of the several wall members 40 in assembly. The limber openings 86 and 87 as well as the lip portion 88 thereof (which is spaced slightly away from the outer ends of the walls 40), serve as a precautionary measure for the drainage of any moisture or condensation which may occur in and along the chute means 38, or that is, in the spacing enclosed by the walls thereof. Thus, if per chance any moisture goes past the barrier wall portion 51 of the backing plate and happens to gravitate or gather within the interior confines of the extension chute means 38, the presence of the openings 86 and 87 as well as lip portion 88 will serve to re-direct such droplets and moisture vertically downwardly as indicated in FIG. 2.

In contemplating the herein described structure, it is particularly noteworthy that the lower open end of the chute structure, i.e., the end from which the coins are dropped vertically into the funnel portion 31 of the coin receptor, is disposed remotely of the coin receiving slot 12 and some distance behind the mounting plate 13, thereby requiring any moisture entering the coin slot to travel laterally a considerable distance before it may filter into the coin receptor. This provides a further guarantee against damage to the coin receptor from water or other liquid being squirted or otherwise introduced into the coin slot.

Having thus described this invention it is believed that those familiar with the art will readily recognize and appreciate its novel approach to the problem confronted; the same generally eliminating the introduction of moisture into the coin receiver even though such moisture be squirted under pressure through the coin receiving slot 12. Further it will be appreciated that while the herein described invention has been disclosed in association with a specific preferred structural arrangement of parts, the same is nevertheless susceptible to modification and variations without departing from the spirit and scope of the revealed invention, as defined in the following appended claims.

The embodiments of the invention in which an exclusive property or privilege is claimed are defined as follows:

1. In a coin operated vending machine having a coin receiving slot and a remotely positioned coin receptor for counting and accumulating deposited coins and their values, a coin chute for gravitationally conveying coins from the coin slot to the receptor, comprising: a drain means defined by a plurality of parallel spaced, vertically disposed wall members located immediately beneath the coin slot and extending rearwardly and downwardly therefrom, the outer edges of said walls remotely of said coin slot acting in concert to form a substantially open bottom wall portion for the coin chute; a backing plate mounted opposite the coin slot and over the upper regions of said wall members in spaced relation thereto to form a generally vertical coin receiving chamber directly behind and below the slot, said backing plate being provided with an operationally horizontally disposed drip bead extending inwardly of said chamber and effective to intercept a flexible tube inserted through said slot and direct the same toward said drain means, and a curvalinear extension chute means communicating with the lower end of said chamber and the upper end of the receptor, said chute means extending rearwardly and downwardly from said chamber in the lower regions of said wall members and having a lower open end communicating with the receptor for delivering coins thereto.

2. In a vending machine having a cabinet enclosing a vending mechanism, a coin receptor for counting and accumulating deposited coins and their values, and means for selecting articles to be vended, apparatus for delivering customer deposited coins to the coin receptor comprising: a mounting plate attachable to the front panel of the machine's cabinet and provided with a slotted opening for the deposit of coins, chute means for conveying coins inserted in said slotted opening to the receptor and having an enclosed coin passageway means extending rearwardly and downwardly from said slotted opening, drain means in the bottom wall of said passageway means for the passage of liquid, comprising plural vertically disposed parallel-spaced rib walls extending rearwardly from the mounting plate and having free edges comprising a bottom coin supporting portion of the coin chute; a backing plate mounted behind said walls opposite said slotted opening and forming a vertical chamber for the initial reception of coins passing into said chute, and a horizontal drip bead on said backing plate to intercept flexible tubing inserted through said slotted opening and deflect the same towards said drain means.

* * * * *